US005507103A

United States Patent [19]

Merritt

[11] Patent Number: 5,507,103

[45] Date of Patent: Apr. 16, 1996

[54] THERMOELECTRIC HAIR DRYER

[76] Inventor: Thomas Merritt, 1957 NE. 149th St., Miami, Fla. 33181

[21] Appl. No.: 375,168

[22] Filed: Jan. 18, 1995

Related U.S. Application Data

[63] Continuation-in-part of Ser. No. 153,363, Nov. 16, 1993, abandoned.

[51] Int. Cl.[6] ..... A45D 20/00

[52] U.S. Cl. ..... 34/97; 34/98; 62/3.4; 392/384

[58] Field of Search ..... 34/96, 97, 98, 34/99, 100, 283; 62/3.61, 3.4; 392/380–385; 165/62

[56] References Cited

U.S. PATENT DOCUMENTS

| | | | |
|---|---|---|---|
| 2,392,405 | 1/1946 | Phipps | 34/98 |
| 3,625,279 | 12/1971 | Mayo | 165/62 |
| 3,863,651 | 2/1975 | Vaiano | 132/9 |
| 4,364,234 | 12/1982 | Reed | 62/3 |
| 4,464,906 | 8/1984 | Outlaw | 34/202 |
| 5,193,347 | 3/1993 | Apisdorf | 62/3.7 |
| 5,282,364 | 2/1994 | Cech | 62/3.2 |

*Primary Examiner*—Denise L. Gromada
*Attorney, Agent, or Firm*—Longacre & White

[57] ABSTRACT

The present disclosure concerns a hair dryer apparatus capable of low power consumption which makes use of a thermoelectric cooling and heating module. The hair dryer includes a motor driven fan which forces ambient air across each opposite face of the thermoelectric module simultaneously and at a high velocity. The thermoelectric module behaves as a heat pump by absorbing heat through a first heat sink in contact with one side of the module, pumping the heat through the module with a low voltage DC electric current, and rejecting the heat through a second heat sink in contact with the second side of the module. Additional Joules heat, created by the power input to the module, is also rejected to ambient through the second heat sink. Air passed over the first heat sink can be mixed with the air passed over the second heat sink by a damper at the air discharge, thereby enabling accurate temperature settings without the use of electronic controls.

5 Claims, 4 Drawing Sheets

THERMOELECTRIC HAIR DRYER

This application is a continuation-in-part of Ser. No. 08/153,363, filed 16 Nov. 1993, now abandoned.

Be it known that I Thomas D. Merritt, a resident of Florida and a citizen of the United States, have invented a certain new and useful invention entitled "Thermoelectric Hair Dryer" of which the following is a Specification.

BACKGROUND OF THE INVENTION a) Field of the Invention

The present invention concerns an apparatus for drying hair.

b) Description of Related Art

Hair drying devices including the widely known hand held hair dryer appliance have been in use for many years. The hair dryers which are most commonly used by the consumer differ very little in fundamental design. The known prior art embodiments include a motor driven fan which forces air across or through a resistance heating element as disclosed in U.S. Pat. No. 3,863,651 to Vaiano wherein the drying apparatus is embodied within a system for washing and conditioning hair. Another technique uses refrigeration components to lower the absolute humidity of the air within the evaporator portion of a refrigeration system, then reheats the air within the condenser portion before passing it over the hair as disclosed in U.S. Pat. 2,392,405 to Phipps. Hair drying apparatus have since been simplified, eventually embodying the common hand held "blow dryer" of contemporary times. These hair dryers, which operate by forcing a stream of air over an extremely hot resistance heating element, are crude but effective. They are generally rated by power input (watts) with the average hair dryer in the consumer market being rated at a power input anywhere from 1200 to 1800 watts. This power requirement using 115 volts of alternating current will draw as much as 13–16 amperes of current and will result in an air temperature of 150–200 degrees Fahrenheit. This temperature range is thought to be required to dry hair, however, these temperatures have been known to cause damage to the hair over a period of time; and the extremely high current draw, which is not economical, also represents a potential electrical shock hazard to the user. The low voltage, low current, thermoelectric dryer described herein represents a radical yet sophisticated departure from the prior art hair dryer designs which are common in the contemporary marketplace.

Thermoelectric refrigeration, which is the principle upon which the present invention is embodied, is based on the Peltier effect, a reciprocal of the Seebeck effect, which was discovered early in the nineteenth century. Both effects deal with the interrelationship of heat energy and electrical energy in a circuit which contains a junction of dissimilar metals, primarily bismuth and tellurium sufficiently doped to create an excess or deficiency of electrons. Much research has been done in the field of electrical power generation as a result of the Seebeck effect exhibited by thermoelectric modules. Electric power results by applying heat to one face of the thermoelectric module while keeping the opposite face at a considerably lower constant temperature.

U.S. Pat. No. 3,625,279 to Mayo discloses a thermoelectric module heated by a radioactive isotope heat source thereby generating power to operate a pump for circulating cooling and/or heating fluids in a flight suit.

Several appliances utilizing thermoelectric modules for cooling are available, the most common being a thermoelectric refrigerator. In a known embodiment, heat sinks are placed in thermal communication with each face of the module. One face of the module is placed within an interior insulated space of the refrigerator, and the opposite face is located exteriorly, exposed to ambient conditions. Electric current is applied to the module and a fan inside the refrigerator forces air over the interior heat sink, which by virtue of contact with the module, absorbs the heat within the insulated space. The heat is rejected from the module when another fan forces air over the exterior heat sink surfaces in contact with the opposite face of the module. The interior space can also be heated simply by changing the direction of current flow to the module thereby causing the interior heat sinks to reject heat absorbed from the air on the exterior. A refrigerator of this type is disclosed in U.S. Pat. No. 4,364,234 to Reed, the essence of which is an elaborate electronic technique for maintaining accurate temperature settings.

A thermoelectric device utilized as a fingernail polish drying apparatus is disclosed in U.S. Pat. No. 4,464,906 to Outlaw. As in Reed, the Outlaw device is essentially used to cool air below ambient temperature with the cool air being recirculated within a closed loop inside a confined space.

Another use of a thermoelectric cooling module is disclosed in U.S. Pat. No. 5,139,347 to Apisdorf, wherein ambient air is forced across the cold face of a module at low velocity and directed toward the face of a helmeted worker in a hot environment, for the purpose of cooling the face of the worker. The heat absorbed from the cool side of the module is rejected at the hot side through a heat sink by natural convection, thereby differing slightly from the aforementioned embodiments. It is important to note in the Apisdorf disclosure that the air must be moving across the cold face of the thermoelectric module at a low velocity in order to obtain the desired cooling effect. In fact, if air is moved at a high velocity, no measurable cooling can be obtained, and no purpose would be served by embodying the module.

U.S. Pat. No. 5,282,364 to Cech also discloses the common structure of a thermoelectric cooling module "sandwiched" between heat sinks. In the Cech disclosure, more focus is directed toward the efficient transfer of heat by use of multiple extrusions forming fins, and once again a fan on the inside of a refrigerator forces air over the interior fins and a fan on the exterior of the refrigerator forces air over the exterior fins.

In all of the aforementioned disclosures, the common component is the thermoelectric module, however, none of these prior art embodiments address the possibility of constant operation at the highest heat pumping capacity of the module.

In the field of thermoelectrics it is widely known that as heat is removed from a confined space, the heat pumping capacity of the module diminishes. This is simply because the interior space being insulated from the ambient has less heat available for the module to remove. Unless the module is cascaded in stages with another module, the lowest temperature which may be obtained in the confined area for all practical purposes is approximately 40 degrees Fahrenheit. At this temperature the module is moving very little, if any, heat. Stated differently, the greater the temperature difference between the hot and cold faces of the module, the less heat pumping capacity is present and consequently the coefficient of performance is lowered proportionately.

A limitation on heating is built into the module as well, because of the materials of which it is constructed. Any heat, including joules heat, produced by the input power to the module, must be rejected rapidly or it will build up and cause the device to stop functioning. There exists the possibility of overheating and melting the low temperature solder which holds the module together. This concern is most prevalent when the module is used for heating or cooling a confined space.

In the present invention described herein, the thermoelectric module is constantly operated at its highest heat pumping capacity, and coincidentally its highest coefficient of performance. This condition is known as DT=0, or zero temperature differential. During this condition, which normally exists for only a very short period of time in any other thermoelectric cooling or heating mode, the module possess the capability of constantly pumping a quantity of heat greater than its normal design capacity, the equation being $Q_h=P_{in}+Q_c$ where $Q_h$ is the heat rejected by the module in watts, $P_{in}$ is the input power, and $Q_c$ is the heat absorbed by the cold face of the thermoelectric device. Stated differently, the performance of the thermoelectric module is boosted to a higher level without concern for adverse effects. Operated at this performance level, for the purpose of heating, the thermoelectric module is well suited for use in a hair dryer, and because the heat which is produced is constantly being discharged to ambient air at high velocity, there is no possibility of heat build-up in the module as in conventional heating uses of the module. The cold side of the module being exposed to the same high velocity airstream supplies the module with substantial amounts of both sensible and latent heat. The air, after having been exposed to the cold face of the module is also discharged to ambient conditions and/or can be mixed with the air which has been exposed to the hot face, thereby providing a unique and simplified method of air temperature adjustment which does not rely on electronic controls. The thermoelectric hair dryer consumes very little power compared to conventional hair dryers and provides a new and unique application for the Peltier effect thermoelectric module.

SUMMARY OF THE INVENTION

In the preferred embodiment, the apparatus of the present invention comprises a hair dryer which makes use of the maximum heat pumping capacity of a Peltier effect, thermoelectric module. The device comprises a housing including an air input and a plurality of air flow channels. The housing also encloses a fan and at least one electric switch. A conduit constructed for the purpose of directing air across both opposite planar faces of a thermoelectric module is supported in the housing. Air is drawn into the housing by the fan and forced into the conduit. The thermoelectric module is associated with upper and lower heat transfer elements, thereby forming an assembly, which is located within the conduit so as to divide or split the airstream created by the fan. This causes a first portion of the air to flow across the hot face of the module, and a second portion of the air to flow over the cold face of the module, and by virtue of the second portion of the air flowing across the cold face of the module, a quantity of heat is removed from the second portion. The heat removed is electronically pumped to the hot face of the module, and ejected from the conduit for the purpose of drying hair.

It has been discovered that operating the thermoelectric module at the DT=0 condition, the module is capable of its highest heat pumping performance. The module can be operated constantly at this performance level with no adverse consequences as long as the heat produced is rejected at a substantial rate. When the heat created by the power input itself (Joules heat) is accounted for, the module is capable of producing a higher quantity of heat than it would under normal conditions (that is to say, when operating at a given temperature difference other than zero). For example, a module which has the capability of pumping 62 watts of heat from the cold face, with input power of 120 watts, would actually be pumping 182 watts of heat. Stated as a formula: $Q_{max}=P_{in}+Q_c$. It may be appreciated that the total amount of heat produced by this arrangement amounts to the sum which is also substantially higher than would normally be produced by the input power (120 watts) alone.

As previously mentioned, the module, located between its upper and lower heat conducting elements, is situated within the discharge conduit so as to create a division of the air flowing through the conduit. At the exit of the conduit the airstream continues to remain divided due to a partition extending in parallel alignment with the conduit. The divided airstream is acted upon by an adjustable air damper means. An adjustable damper, attached to the partition, for redirecting a portion of the split airstream allows different air flow mixtures, therefore different temperatures of air to be produced. This is accomplished by positioning the damper within the exiting airstream so as to affect the direction of air flowing past the module, thereby allowing more or less of either hot or ambient air to predominate the mixture. With the damper in a neutral position, a warm temperature is created. With the damper in a position wherein the second portion of air which flows across the cold face of the module is restricted, a hot air temperature is produced; and with the damper restricting the hot air completely, a cool air temperature is produced. In actuality, the term "cool" is a relative term in that air velocity in the device is so high that no measurable decrease is detected in the second portion of the air flowing across the lower heat transfer element. However, ambient temperatures of air can be produced by adjusting the damper to a position which equates with a desired temperature. This means of controlling air temperatures is a feature which eliminates electrical or electronic means of accomplishing the same, thereby making the present invention simpler and with fewer parts, therefore less complex to construct.

In a specific embodiment, the conduit within which the air is directed is placed within another larger conduit with a resulting volume of space in between the conduits. The thermoelectric module, as well as the upper and lower heat transfer elements comprise an assembly which is placed within the smaller conduit in substantial thermal communication with the inner surfaces of the smaller conduit thereby causing a portion of the heat being rejected by the module to be transferred to the smaller conduit. As heat moves through the smaller conduit, it is further transferred to the heat transfer element in thermal communication with the cold face of the module, thereby creating a thermal feedback loop. It should be appreciated that whereas prior embodiments of devices embodying thermoelectric modules strive by various means to eliminate any heat transfer from the cold face to the hot face (for example, using plastic screws rather than metal screws to hold the thermoelectric assembly together), in the present invention it is desirable and beneficial for heat to circulate through a feedback loop. A third portion of the air is channeled into the space created between the smaller and larger conduits, for removing any additional heat from the smaller conduit. The third portion of air rejoins the airstream which is discharged from the smaller conduit, adding heat to the airstream. The arrangement of the smaller conduit within the larger conduit comprises essentially a heatpipe assembly, which will directly improve thermal management in the preferred embodiment by virtue of the heatpipe assembly behaving as an extension of the heat transfer elements which are in intimate contact with the thermoelectric module. The arrangement of the thermoelectric module in combination with the smaller and larger conduits, as well as the aforementioned temperature adjustment means, is beneficial in that this arrangement allows constant maximum heating performance capability of the Peltier effect thermoelectric module. Further, temperature adjustment of the air is simplified by eliminating complex electronic controls, thereby achieving substantially new and extraordinary results.

In another specific embodiment of the present invention, the hair dryer is powered with a rechargeable battery which can be installed within the handle or any other appropriate area. This will render the device "cordless" and extremely portable as a result of the low power consumption of the device. Batteries constructed of lithium, nickel cadmium, or nickel metal hydride are all suitable and of sufficient energy density to be accommodated within the device. With new battery technology emerging, it is possible to form rechargeable lithium poly batteries into any shape or form thereby allowing the housing itself to serve as a power supply for the device. This is entirely feasible inasmuch as these batteries demonstrate energy to weight ratios of approximately 20 times that of comparable size nickel cadmium or nickel hydride batteries.

Accordingly, it is an object of the present invention to provide a hair dryer using a thermoelectric module operating at substantially a zero temperature differential between its hot and cold faces.

It is a further object of the present invention to provide a hair dryer which operates on low voltage and low amperage, such that the hair dryer can be powered by a rechargeable battery, thereby eliminating the dangerous electrical shock hazard currently existing in conventional electric hair drying apparatus.

It is yet a further object of the present invention to provide a hair dryer which will not damage hair.

It is yet a further object of the present invention to provide a simplified means for controlling the temperature of air being discharged from a hair dryer without dependence on electrical or electronic controls.

The above and yet further objects and advantages of the present invention will become apparent in view of the following Detailed Description of the present invention, as well as the Drawings and Claims appended herewith.

DESCRIPTION OF THE PREFERRED EMBODIMENT

Figure 1:
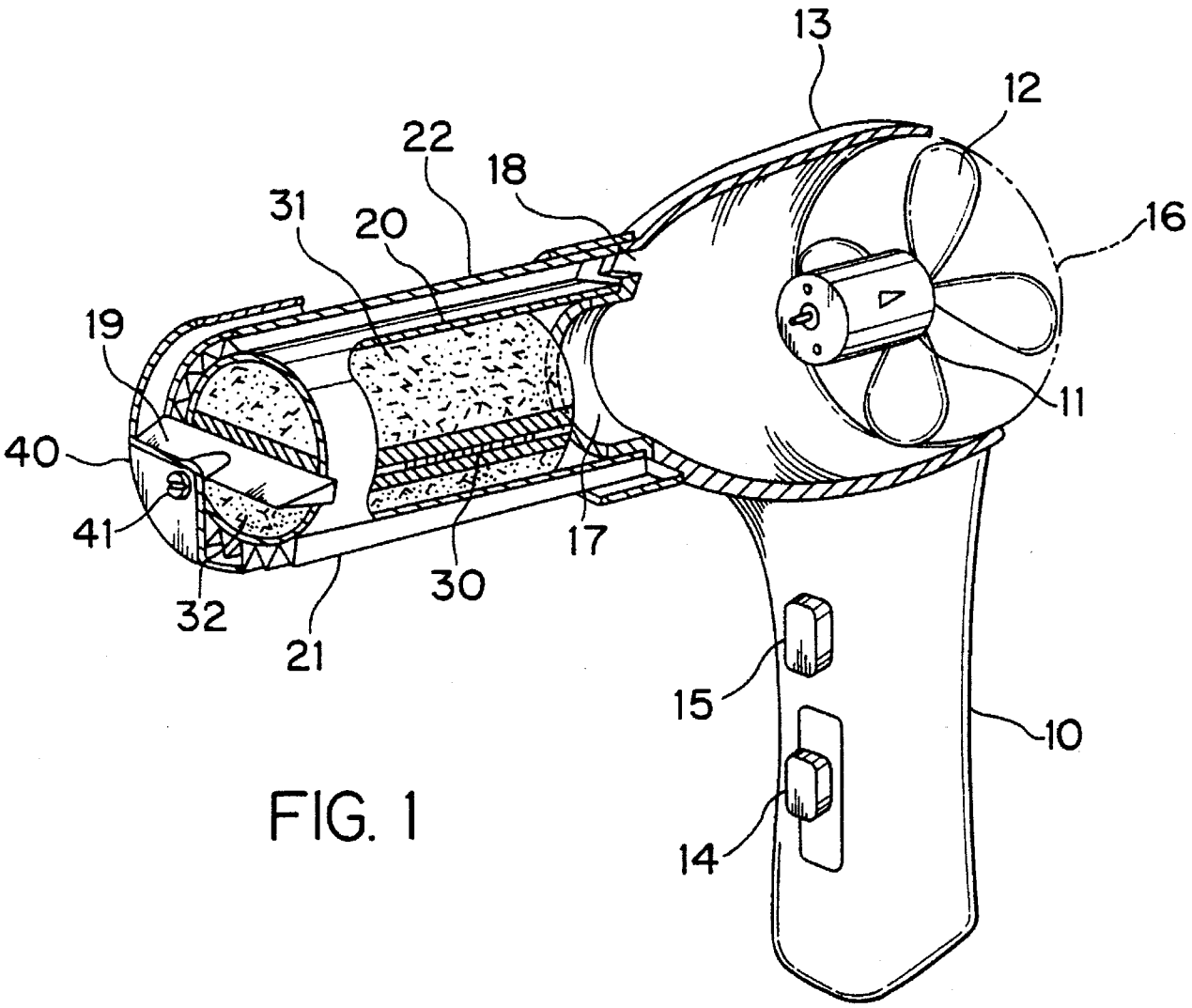
FIG. 1 is an isometric cutaway view of a preferred embodiment of the present invention.
Figure 2:
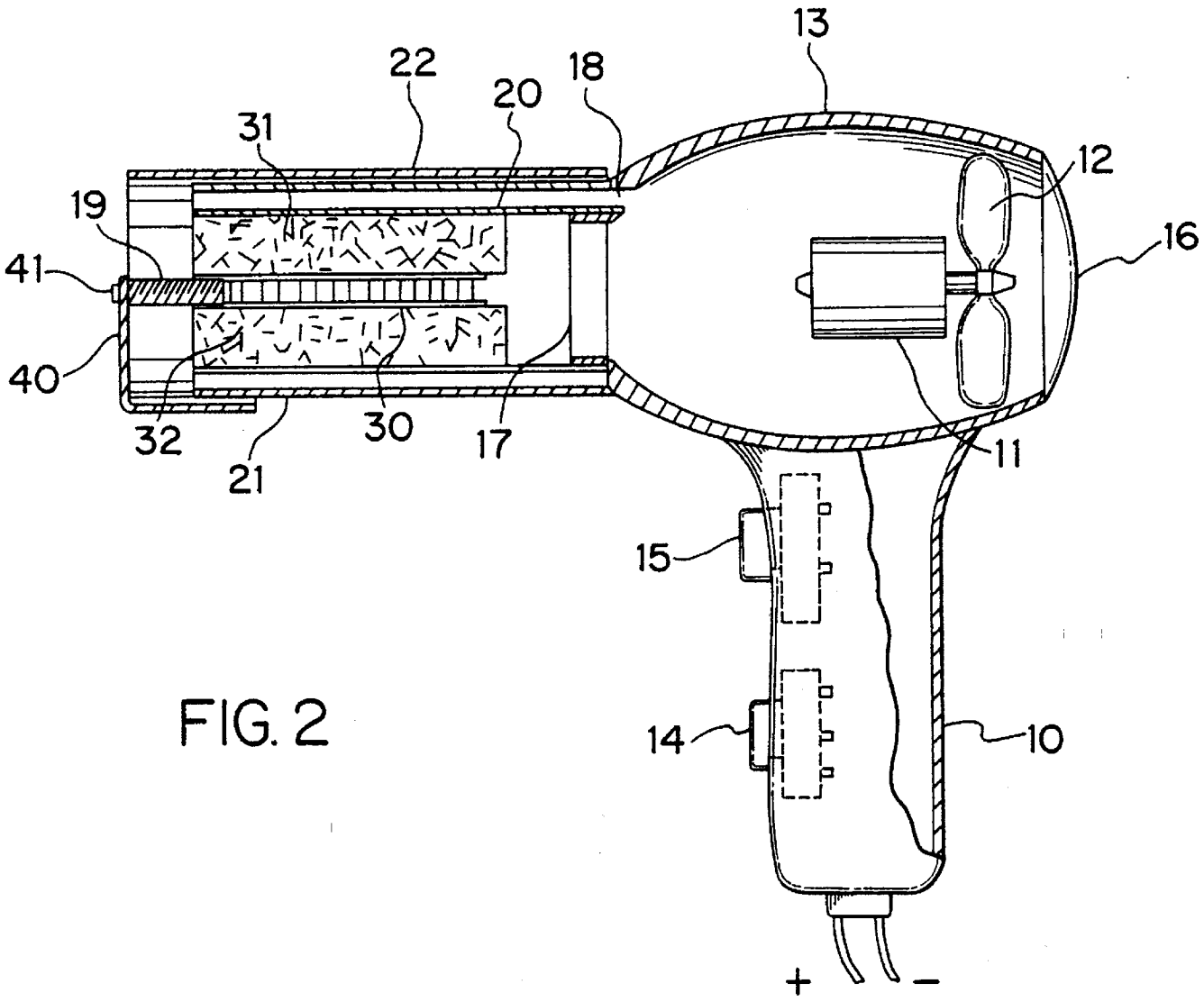
FIG. 2 is a cross-sectional side view of the preferred embodiment illustrated in FIG. 1.

The present invention relates to hair dryers. With reference to FIGS. 1 and 2, a dryer 10 with a fan 12 driven by a motor 11 is shown. The motor 11 and the fan 12 are enclosed within a housing 13. Within the housing 13, switches 14 and 15 are included. When switch 14 is closed, electric current causes motor 11, and hence fan 12, to rotate, thereby causing air to be drawn in through an air input 16 and creating an airstream of substantial velocity which is forced through air output exits 17 and 18. It is to be understood that exit 17 is the main exit for the airstream and exit 18 is a bypass exit, therefore the majority of the air will pass through exit 17.

The majority of the airstream enters a conduit 20 which is placed within and in thermal communication with a corrugated conduit 21. Both conduits 20 and 21 are in fluid communication with housing 13 via exits 17 and 18, respectively. As the airstream enters conduit 20, a division of the airstream occurs by virtue of contact with a thermoelectric module 30.

When switches 14 and 15 are closed, motor 11 and module 30 are energized. Module 30, which is in thermal communication with upper and lower heat transmission elements 31 and 32, absorbs heat from the ambient air through element 31 and electronically pumps the heat to heat transmission element 32. Heat transmission element 32 will attain a temperature substantially higher than ambient by virtue of thermal communication with the hot surface of module 30 and will now warm a first portion of the majority airstream which has come into contact with heat transmission element 32. This results in air of relatively high temperature and relatively low humidity, which is then ejected for the purpose of drying hair.

Heat transmission elements 31 and 32 are constructed of a material of low thermal resistance such as DUOCEL© which is essentially a porous ligament cell structure commonly known as blown metal foam. Such a material is manufactured by E R G Materials and Aerospace of Oakland, Calif. This material will allow module 30 to operate at the highest possible temperature, without any adverse effects, while offering very low resistance to airflow. Other suitable materials can be substituted as required.

As previously stated, conduit 20 is placed within corrugated conduit 21 with an air channel formed between conduits 20 and 21. This arrangement provides an air channel through exit 18 for air to flow longitudinally through the space created between the conduits 20 and 21. This air removes any heat which may have been transferred to conduit 20 from heat transmission element 31. A cover 22 placed over at least a portion of corrugated conduit 21 prevents air from escaping. If conduit 21 is not corrugated, cover 22 is not necessary. The air, which is now somewhat heat laden rejoins the majority airstream flowing through the inner conduit 20 at a divider 19. Divider 19 keeps the airstream split as it exits conduit 20, as well as functions as a mount for damper 40.

Figure 3:
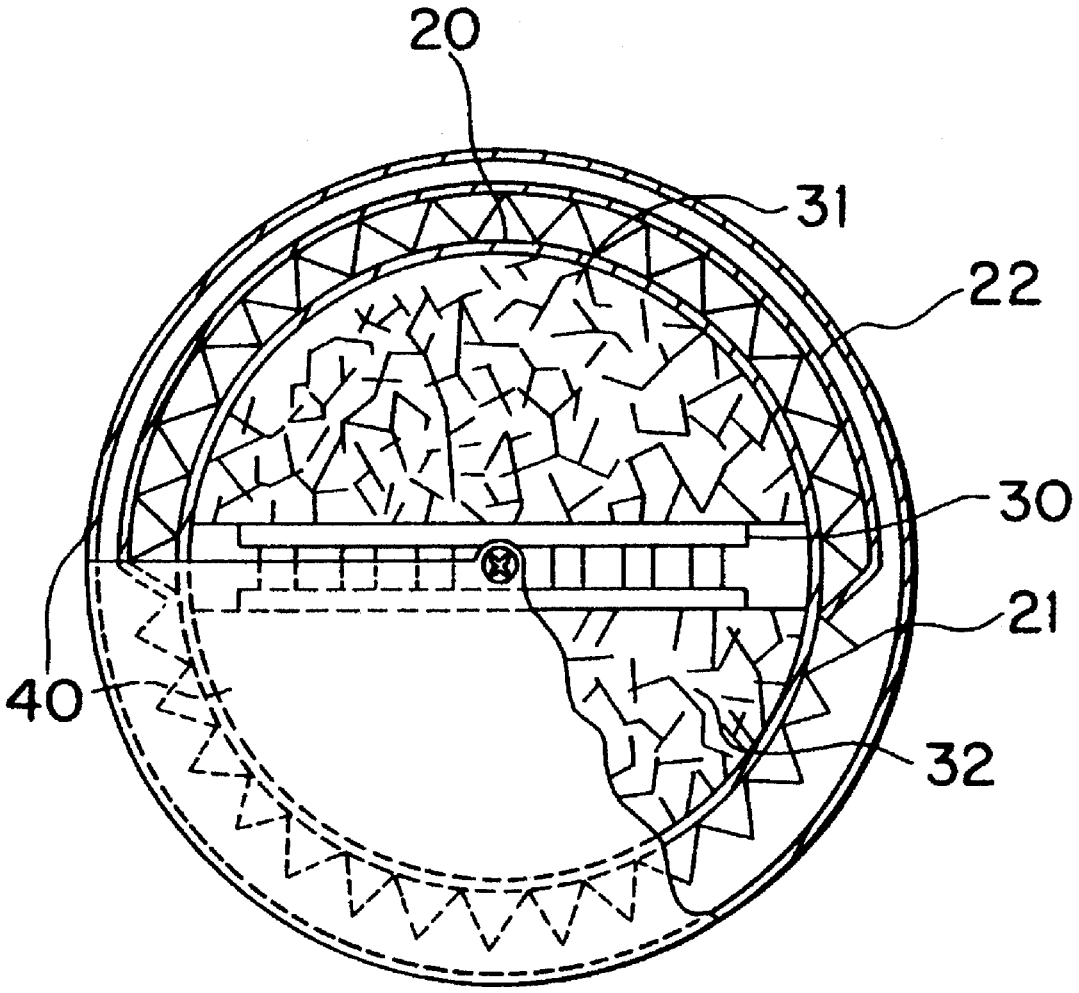
FIG. 3 is an end view of the heatpipe portion of the preferred embodiment illustrated in FIGS. 1 and 2 showing the thermoelectric module assembly within the heatpipe and the temperature control means.

With reference to FIGS. 1, 2 and 3, damper 40 is for the purpose of allowing different mixtures of air, and hence different temperatures, to be created without having to resort to electronic controls. Damper 40 is mounted on an axis 41 which enables it to rotate 360 degrees in either direction. Damper 40 is also designed to redirect a portion of the airstream, while allowing the remaining portion to be discharged for use in drying hair. Any damper means may be utilized as long as provisions for airflow requirements over the thermoelectric module 30 are satisfied.

Another method to control discharge air temperature is by opening switch 15 which is in series with module 30. When the electric power no longer flows through module 30, ambient temperature air will be discharged from the dryer 10. This method of controlling temperature will not allow the operator to vary temperature between hot and ambient, as damper 40 will allow, but can be useful for some purposes.

It should be understood that while damper 40 is for the purpose of achieving variations in air temperature thereby eliminating electronic means to accomplish the same, some form of electronic temperature control can be included in the present invention.

Figure 4:
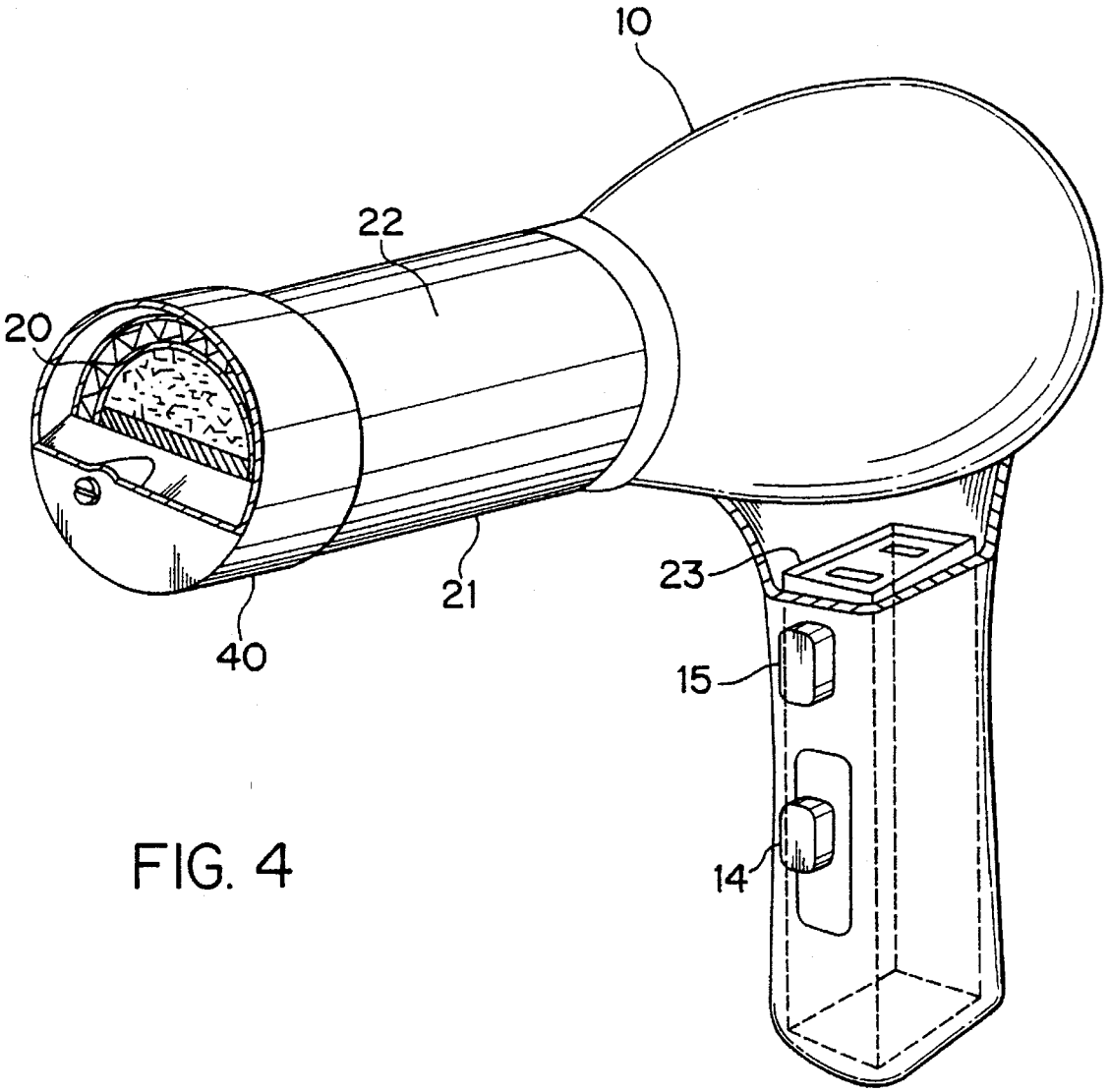
FIG. 4 is an isometric view of the present invention specifically showing a self contained battery power supply means.

With reference to FIG. 4, a rechargeable battery 23 is specifically included in the present invention. Battery 23 is shown within a handle portion of the dryer 10. It is to be understood that battery 23 can be formed in any shape, including the shape of the housing 13, whereby battery 23 is not a separate part of the present invention.

Accordingly, while a preferred embodiment of the present invention is shown and described herein, it will be understood that the invention may be embodied otherwise than as herein specifically illustrated or described, and that within the embodiments certain changes in the detail and construction, as well as the arrangement of the parts, may be made without departing from the principles of the present invention as defined by the appended claims.

I claim:

1. A hair dryer, comprising:

(a) a motor;

(b) fan means driven by said motor for creating a stream of air;

(c) an electrical circuit, said electrical circuit including at least one switch for opening and closing said electrical circuit;

(d) a housing enclosing said fan, said electrical circuit and said motor, said housing having an air input aperture and at least one air output exit;

(e) a conduit in fluid communication with said at least one air output exit of said housing whereby air exiting from said at least one air output of said housing will pass longitudinally through said conduit; and (f) a thermoelectric module in electrical communication with said electrical circuit, said module is supported within said conduit so as to divide said stream of air, whereby first and second portions of said stream of air flow over opposite planar faces of said thermoelectric module, said thermoelectric module operating with a substantially zero degree temperature differential between said opposite planar faces.

2. The hair dryer recited in claim 1, wherein said thermoelectric module is in substantial thermal communication with said conduit whereby at least a portion of heat rejected by one of said opposite planar faces of said thermoelectric module is absorbed by said conduit, said portion of heat is subsequently absorbed by another one of said opposite planar faces, and said thermoelectric module constantly pumps heat at maximum capacity.

3. The hair dryer recited in claim 1, further comprising:

(g) adjustable damper means for varying air temperatures.

4. The hair dryer recited in claim 3, further comprising:

(h) a rechargeable battery, whereby said dryer is completely portable.

5. The hair dryer recited in claim 4, wherein said battery is substantially shaped in the form of said housing.

* * * * *